US007703711B2

(12) United States Patent
Smith

(10) Patent No.: US 7,703,711 B2
(45) Date of Patent: Apr. 27, 2010

(54) COMBINATION SHREDDER-STORAGE UNIT

(76) Inventor: Johnice C. Smith, 2620 W. 23rd Pl., Gary, IN (US) 46404

( * ) Notice: Subject to any disclaimer, the term of this patent is extended or adjusted under 35 U.S.C. 154(b) by 347 days.

(21) Appl. No.: 11/749,877

(22) Filed: May 17, 2007

(65) Prior Publication Data

US 2007/0295843 A1 Dec. 27, 2007

Related U.S. Application Data

(60) Provisional application No. 60/747,434, filed on May 17, 2006.

(51) Int. Cl.
*B02C 23/00* (2006.01)
*B02C 1/10* (2006.01)

(52) U.S. Cl. ..... 241/100; 241/101.2

(58) Field of Classification Search ..... 241/37.5, 241/100, 101.2; 312/280, 290, 249.11, 249.12, 312/330, 278

See application file for complete search history.

(56) References Cited

U.S. PATENT DOCUMENTS

| | | | | | |
|---|---|---|---|---|---|
| 1,849,112 | A * | 3/1932 | Poplawski | 99/501 |
| 2,569,828 | A * | 10/1951 | Peacock et al. | 312/100 |
| 2,732,274 | A * | 1/1956 | Cottom | 312/280 |
| 2,778,704 | A * | 1/1957 | Joachim | 312/309 |
| 3,009,752 | A * | 11/1961 | Margulis | 312/280 |
| 3,082,050 | A * | 3/1963 | Baxter et al. | 312/209 |
| 3,323,728 | A * | 6/1967 | Shepherd | 241/36 |
| 3,442,393 | A * | 5/1969 | Irvin | 211/13.1 |
| 4,664,317 | A * | 5/1987 | Morton | 241/36 |
| 5,302,013 | A * | 4/1994 | Reiner | 312/249.11 |
| 5,716,116 | A * | 2/1998 | Carlson et al. | 312/280 |
| 6,079,645 | A * | 6/2000 | Henreckson et al. | 241/37.5 |
| 6,186,428 | B1 * | 2/2001 | Robinson et al. | 241/65 |
| 7,104,481 | B2 * | 9/2006 | Schenker | 241/100 |
| 2007/0018020 | A1 * | 1/2007 | Wang | 241/100 |
| 2007/0210685 | A1 * | 9/2007 | Paquette et al. | 312/249.12 |

* cited by examiner

*Primary Examiner*—Faye Francis
(74) *Attorney, Agent, or Firm*—Hartman & Hartman, P.C.; Gary M. Hartman; Domenica N. S. Hartman

(57) ABSTRACT

A combination shredder and storage unit that combines various desirable features. The unit includes a cabinet having lower and upper ends and front, rear and side faces. A front access is located in the front face and configured to permit access to the interior of the cabinet. An upper opening is located in the upper end of the cabinet through which a shredding device within the cabinet is accessed. A door is provided for opening and closing the upper opening to allow and prevent access to the shredding device. A receptacle within the cabinet is sized for receiving and storing shredded material, and is accessible by opening the front access of the cabinet. The unit also includes at least one exterior storage compartment on the front access of the cabinet, and at least one closable drawer located beneath the receptacle. The unit can be configured as a floor-standing unit, as well as much smaller counter and wall-mounted units.

18 Claims, 2 Drawing Sheets

COMBINATION SHREDDER-STORAGE UNIT

CROSS REFERENCE TO RELATED APPLICATIONS

This application claims the benefit of U.S. Provisional Application No. 60/747,434 filed May 17, 2006, the contents of which are incorporated herein by reference.

BACKGROUND OF THE INVENTION

The present invention generally relates to office equipment, and more particularly a single unit that combines a paper shredder and storage features that can be sized as a floor unit or to readily fit on a counter or be hung on a wall, with the shredding mechanism preferably being accessible at a height that reduces stress placed on the user's hands, arms and back, thereby decreasing the risk of potential work-related injuries.

Paper shredders are commercially available that have the ability to produce cross cuts, strip cuts, and paper confetti. Commercial shredders presently common on the market include heavy-duty units sized to handle large volumes of office usage, including storage of the resulting shredded paper. Because of their size, some commercial shredders are adapted to be moved on casters or rollers. Otherwise, shredders typically available for purchase are specifically adapted for the limited purpose of shredding paper and like materials.

BRIEF SUMMARY OF THE INVENTION

The present invention provides a combination shredder and storage unit that combines various desirable features, including storage space for documents to be shredded, storage compartments for storing supplies used in conjunction with the unit, and safety covers capable of selectively preventing the operation of the unit. The unit can be configured as a floor-standing unit, as well as much smaller counter and wall-mounted units.

The unit includes a cabinet having a lower end, an upper end, oppositely-disposed front and rear faces between and interconnecting the upper and lower ends, and oppositely disposed side faces between and interconnecting the upper and lower ends and between and interconnecting the front and rear faces. A front access is located in the front face of the cabinet, and configured to be opened and closed to enable and obstruct, respectively, access to an interior volume of the cabinet defined and enclosed by the front, rear, and side faces of the cabinet. An upper opening is located in the upper end of the cabinet, through which a shredding device within the cabinet is accessible. A feature is provided for opening and closing the upper opening and thereby allows and prevents, respectively, access to the shredding device. The unit further includes a receptacle sized for receiving and storing shredded material from the shredding device. The receptacle is located below the shredding device and within the interior volume of the cabinet. The receptacle is accessible by opening the front access of the cabinet so as to permit removal of the shredded materials therein. The unit also includes at least one exterior storage compartment on the front face of the cabinet, and at least one closable drawer accessible at the front face of the cabinet and located within the cabinet beneath the receptacle.

In view of the above, it can be seen that the combination shredder and storage unit of this invention provides various accessories and conveniences not found in commercially available shredders. The unit is preferably sized and configured as a floor-standing unit or as a compact unit, preferably to permit placement on a counter, desk, or wall, and in each case to locate access to the shredder at a comfortable height to reduce stress placed on the hands, arms and back of a user, thereby decreasing the risk of potential work-related injuries.

Other objects and advantages of this invention will be better appreciated from the following detailed description.

DETAILED DESCRIPTION OF THE INVENTION

Figure 1:
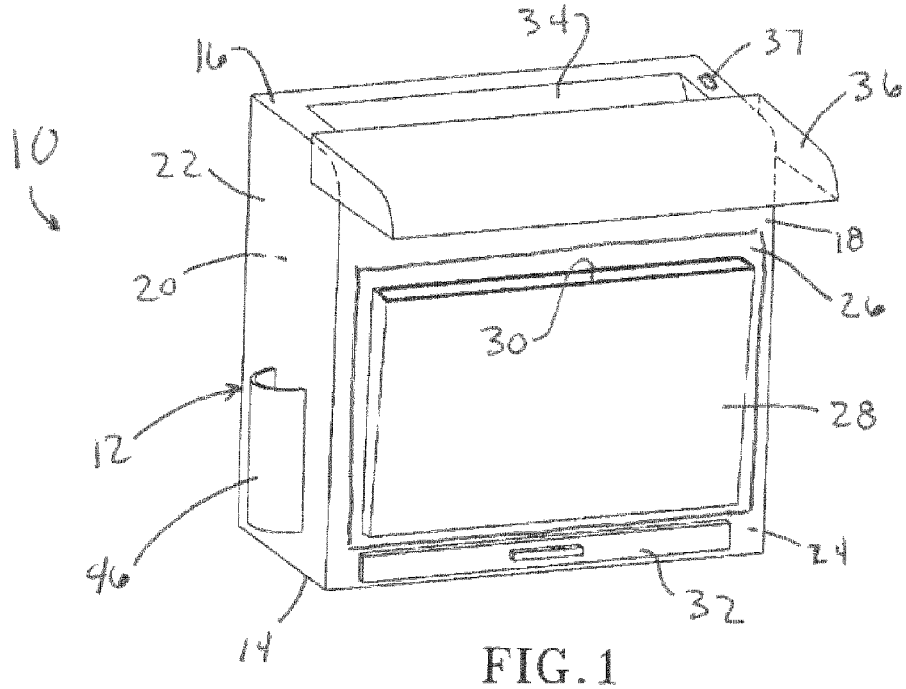
FIG. 1 is a front perspective view of a compact combination shredder and storage unit in accordance with a first embodiment of this invention.
Figure 2:
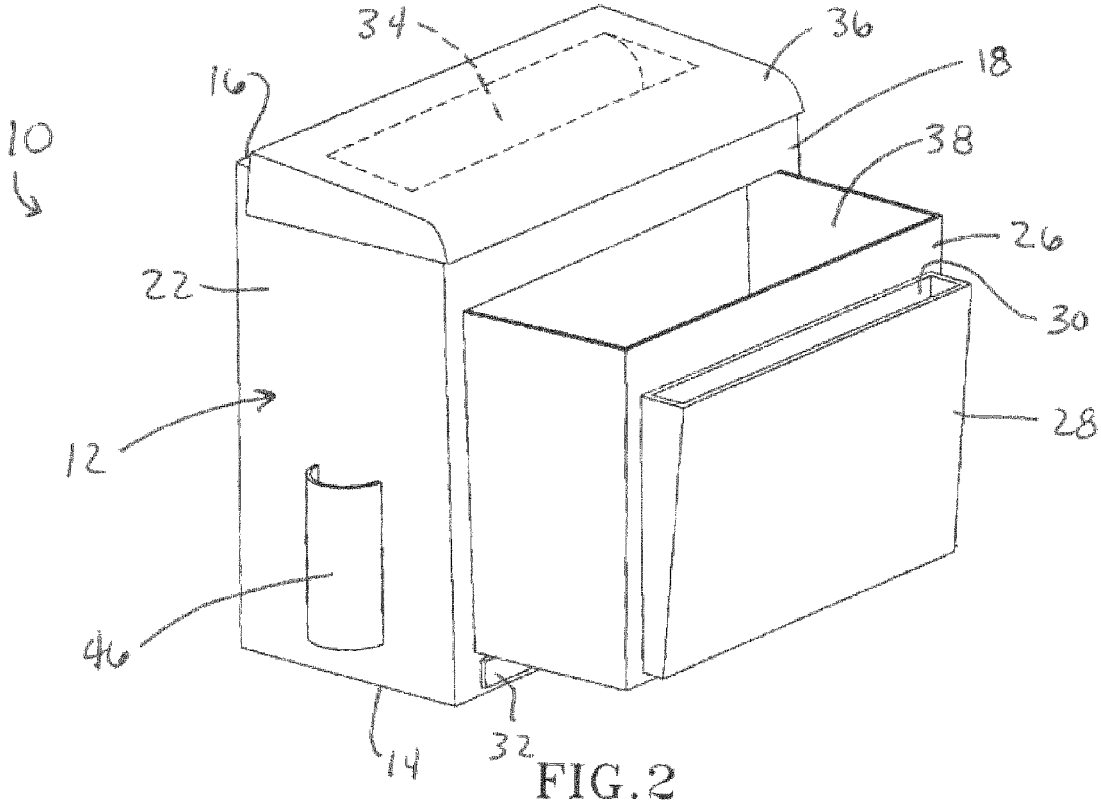
FIG. 2 is a second front perspective view of the unit of FIG. 1, showing a drawer that has been opened in the front face of the unit to permit removal of shredded materials.
Figure 3:
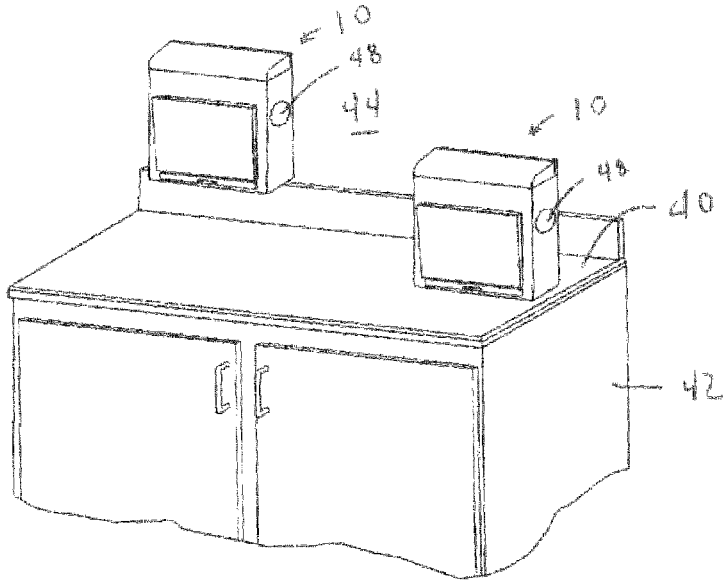
FIG. 3 shows the unit of FIG. 1 mounted to a wall and resting on a counter in accordance with preferred aspects of the first embodiment of this invention.

FIGS. 1 through 3 represent a combination shredder and storage unit 10 in accordance with a first embodiment of the invention. The unit 10 is considered to be compact, in that the unit 10 is sized to be hung from a wall with conventionally available wall-hanging hardware (such as anchor screws, picture hanging wire, etc.), or placed on a counter or desk. The unit 10 is particularly intended to be sized so that, when resting on a counter or desk, access to the shredder of the unit 10 (to be described below) is located between waist and shoulder height so that a user is not required to stoop, bend, or reach while feeding papers and other materials into the shredder.

The compact combination shredder and storage unit 10 represented in FIGS. 1 through 3 can be seen to include a cabinet 12 with a lower end 14, an upper end 16, oppositely-disposed front and rear faces 18 and 20 that are between and interconnect the lower and upper ends 14 and 16, and oppositely disposed side faces 22 and 24 that are between and interconnect the lower and upper ends 14 and 16 and are between and interconnect the front and rear faces 18 and 20. The cabinet 12 preferably has a maximum height of less than twenty inches, so that when resting on a counter or desk, its upper end 16 is located at not greater than shoulder height or less than waist height of a person of average stature. Representative but nonlimiting dimensions for the cabinet 12 include a height and width of about 12 inches (about 30 cm) and a depth of about 6 inches (about 15 cm). The cabinet 12 can be manufactured from various materials, with plastics and other lightweight materials being preferred.

To permit its placement on the surface 40 of, for example, a counter 42 as shown in FIG. 3, the lower end 14 of the cabinet 12 is preferably flat or otherwise adapted to rest on the surface 40 so that the front, rear, and side faces 18, 20, 22, and 24 are all substantially perpendicular to the surface 40. Alternatively, if the unit 10 is to be hung on a wall 44 as also shown in FIG. 3, the unit 10 is preferably equipped with suitable hardware capable of mounting the unit 10 to the wall 44, such as one or more tabs for engaging anchor screws threaded into the wall 44 or attaching a wire hanger, lag bolts that can be threaded through the rear face 20 and into wall studs, etc.

Such hardware are well known and therefore do not need further explanation or illustration.

The cabinet 12 includes a front door 26 that provides access to the interior of the cabinet 12, and as such is configured to be opened and closed to enable and obstruct, respectively, access to the interior of the cabinet 12 (as defined and enclosed by the front, rear, and side faces 18, 20, 22, and 24 of the cabinet 12). An exterior storage compartment 28 is mounted to the exterior surface of the front door 26, with an opening thereto formed as a slot 30 through which papers can be placed for storage, such as received mail, mail to be sent, to-do lists, grocery lists, etc. A drawer 32 is shown as being located beneath the compartment 28 so as to be accessible at the front face 18 of the cabinet 12. The drawer 32 is preferably sized to accommodate miscellaneous items such as keys, stamps, envelopes, note pads, wallets, etc.

A shredder opening 34 is formed in the upper end 16 of the cabinet 12 through which papers and similar materials can be fed to a shredder (not shown) located within the upper end 16 immediately beneath the opening 34. The opening 34 can be of any suitable size, though preferably sized to accommodate standard paper dimensions, e.g., at least 8.5 inches (about 21.6 cm). The shredder is sized to accommodate papers that can be fed through the opening 34, but otherwise can be of any type known and commercially available from shredder manufacturers, as well as those yet to be developed. The opening 34 is shown being closable by a shredder door 36 that can be used to selectively allow and prevent access to the shredder. The door 36 is shown as being opened and closed by sliding in a forward-rearward direction, though other configurations are possible, such as a pivoting door. The door 36 preferably operates a switch 37 that renders the shredder inoperable when the door 36 is closed.

Shredded material that has passed through the shredder drops into a receptacle 38 sized to store a suitable amount of shredded material. The receptacle 38 is located within the interior of the cabinet 12 immediately below the shredder, and is accessed by opening the front door 26 to permit removal of shredded material. As depicted in FIGS. 1 through 3, the front door 26 defines nearly the entire front face 18 of the cabinet 12 to maximize access to the receptacle 38 while minimizing the overall size of the cabinet 12.

As evident from FIGS. 1 through 3, the unit 10 can be equipped with additional features of convenience. For example, FIGS. 1 and 2 show a pencil storage container 46 mounted on the lefthand side face 22, and FIG. 3 shows a window 48 formed in the righthand side face 24 of the cabinet 12. The window 48 is located to permit the contents of the receptacle 38 to be viewed without the need to open the front door 26.

In combination, the above features make the unit 10 particularly useful at home while sorting mail. For example, junk mail and potentially sensitive information can be immediately shredded while the user is seated at the counter 42 on or above which the unit 10 is located, while valuable mail can be placed in the compartment for safekeeping. For this purpose, the compartment 38 preferably has interior dimensions that accommodate standardized document sizes, such as at least 8.5 by 11 inches (about 21.6 by 28 cm).

Figure 4:
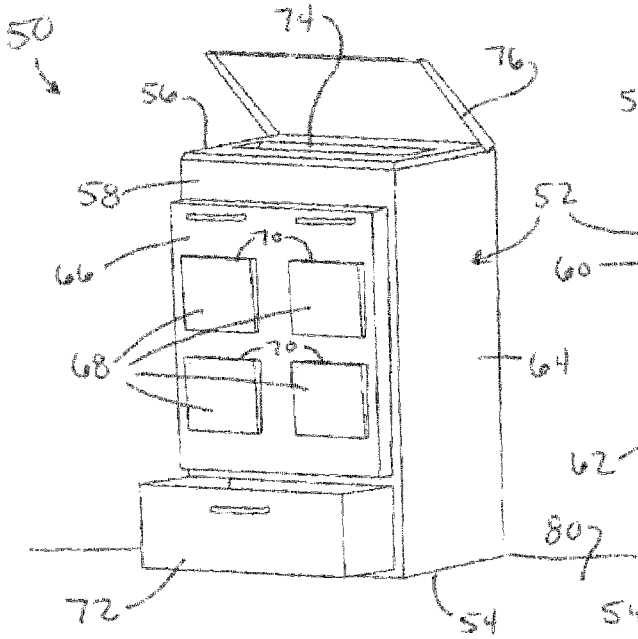
FIG. 4 is a front perspective view of a floor-standing combination shredder and storage unit in accordance with a second embodiment of this invention.
Figure 5:
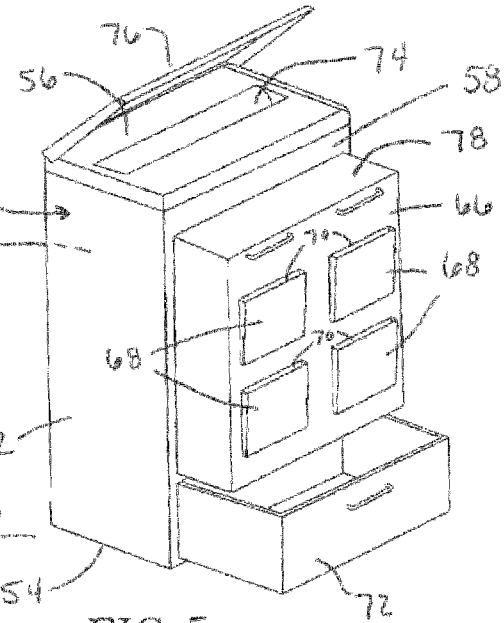
FIG. 5 is a second front perspective view of the unit of FIG. 4, showing a drawer that has been opened in the front face of the unit to permit removal of shredded materials.

FIGS. 4 and 5 depict a shredder and storage unit 50 similar to that shown in FIGS. 1 through 3, but much larger and configured as a floor-standing unit. Similar to the previous unit 10, the unit 50 shown in FIGS. 4 and 5 includes a cabinet 52 having a lower end 54, upper end 56, oppositely-disposed front and rear faces 58 and 60, and side faces 62 and 64. For accessibility as a floor-standing unit, the lower end 54 is adapted to rest on a floor 80 so that the front, rear, and side faces 58, 60, 62, and 64 of the cabinet 52 are substantially perpendicular to the floor 80, and the upper end 56 of the cabinet 52 is preferably spaced at least forty inches (about one meter) above the lower end 54, though preferably not greater than about fifty inches (about 1.25 meters) above the lower end 54 so that the upper end 56 is located not greater than shoulder height or less than waist height of a person of average stature.

As with the first embodiment, the cabinet 52 is equipped with a front door 66 that defines almost the entire front face 56 of the cabinet 52, and is configured for gaining access to the interior of the cabinet 52 as defined and enclosed by the front, rear, and side faces 58, 60, 62, and 64 of the cabinet 52. A shredder (not shown) is located within the cabinet 52 near its upper end 56, to which paper and other materials can be fed through a shredder opening 74 located in the upper end 56 of the cabinet 52 immediately above the shredder. The shredder opening 74 is closed by a shredder door 76 pivotally attached near where the upper end 56 and rear face 60 of the cabinet 52 meet. Within the cabinet 52, a receptacle 78 is located immediately below the shredder and sized to receive and store shredded material as it exits the shredder. The receptacle 78 is accessible by opening the front door 66 of the cabinet 52 to permit removal of the shredded materials. Finally, a number of exterior storage compartments 68 are shown mounted to the exterior surface of the front door 66, and a drawer 72 is located within the cabinet 52 beneath the front door 66 and its receptacle 78. The drawer 72 is preferably large enough to accommodate bags for use as liners for the receptacle 78. The compartments 68 are particularly useful in an office environment, in that multiple individuals can place documents to be shredded in the compartments 68, some of which may be designated for certain types of documents. For this purpose, at least some of the compartments 68 preferably have interior dimensions that can accommodate standardized document sizes, such as at least 8.5 by 11 inches (about 21.6 by 28 cm).

While the invention has been described in terms of specific embodiments, it is apparent that other forms could be adopted by one skilled in the art. For example, the physical configurations of the units 10 and 50, their cabinets 12 and 52, and their various features could differ from those shown. Therefore, the scope of the invention is to be limited only by the following claims.

The invention claimed is:

1. A combination shredder and storage unit comprising:

a cabinet having a lower end, an upper end, oppositely-disposed front and rear faces between and interconnecting the upper and lower ends, and oppositely disposed side faces between and interconnecting the upper and lower ends and between and interconnecting the front and rear faces;

a front access door that defines greater than half of the front face of the cabinet, the front access door being configured for opening and closing to enable and obstruct, respectively, access to an interior volume of the cabinet defined and enclosed by the front, rear, and side faces of the cabinet;

means located beneath the upper end of the cabinet for shredding sheet material and depositing shredded material into the interior volume;

a shredder opening located in the upper end of the cabinet and adapted for feeding the sheet material therethrough to the shredding means;

a shredder door adapted to have open and closed positions, the shredder door exposing the shredder opening thereby allowing feeding of the sheet material through the shredder opening and to the shredding means when in the open position, the shredder door covering substantially all of the upper end of the cabinet, defining a substantially horizontal support surface, and closing the shredder opening thereby preventing feeding of the sheet material through the shredder opening and to the shredding means in the closed position;

a receptacle sized for receiving and storing the shredded material from the shredding means, the receptacle being located below the shredding means and within the interior volume of the cabinet, the receptacle being accessible by opening the front access door of the cabinet so as to permit removal of the shredded materials therein;

at least one exterior storage compartment on the front access door and accessible from the front face of the cabinet; and at least one closable drawer accessible at the front face of the cabinet and located within the cabinet beneath the receptacle and beneath the front access door.

2. The combination shredder and storage unit according to claim 1, wherein the lower end of the cabinet is adapted to rest on a support surface so that the front, rear, and side faces of the cabinet are substantially perpendicular to the support surface.

3. The combination shredder and storage unit according to claim 1, further comprising means located at the rear face of the cabinet for mounting the cabinet on a wall.

4. The combination shredder and storage unit according to claim 1, further comprising at least a second exterior storage compartment on at least one of the side faces of the cabinet.

5. The combination shredder and storage unit according to claim 4, wherein the second exterior storage compartment has a vertical extent greater than a horizontal extent so as to accommodate writing utensils therein.

6. The combination shredder and storage unit according to claim 1, further comprising a window defined in at least one of the side faces of the cabinet and through which the shredded material within the receptacle is visible.

7. The combination shredder and storage unit according to claim 1, wherein the at least one exterior storage compartment comprises a plurality of exterior storage compartments on the front access door.

8. The combination shredder and storage unit according to claim 1, wherein the shredding means is inoperable when the shredder opening is closed by the shredder door.

9. The combination shredder and storage unit according to claim 1, wherein the shredder door is slidably movable in forward and rearward directions corresponding to the front and rear faces, respectively, of the cabinet.

10. The combination shredder and storage unit according to claim 1, wherein the shredder door is pivotally movable in forward and rearward directions corresponding to the front and rear faces, respectively, of the cabinet.

11. The combination shredder and storage unit according to claim 1, wherein the cabinet has a maximum dimension of less than twenty inches.

12. The combination shredder and storage unit according to claim 1, wherein the cabinet has a maximum dimension of less than fifteen inches.

13. The combination shredder and storage unit according to claim 1, wherein the cabinet has a maximum dimension of greater than forty inches.

14. The combination shredder and storage unit according to claim 1, wherein the upper end of the cabinet is spaced at least forty inches above the lower end of the cabinet.

15. A floor-standing combination shredder and storage unit comprising:

a cabinet having a lower end, an upper end spaced at least forty inches above the lower end, oppositely-disposed front and rear faces between and interconnecting the upper and lower ends, and oppositely disposed side faces between and interconnecting the upper and lower ends and between and interconnecting the front and rear faces, the lower end being adapted to rest on a support surface so that the front, rear, and side faces of the cabinet are substantially perpendicular to the support surface;

a front door defining greater than half of the front face of the cabinet, the front door being configured for opening and closing to enable and obstruct, respectively, access to an interior volume of the cabinet defined and enclosed by the front, rear, and side faces of the cabinet;

means located beneath the upper end of the cabinet for shredding sheet material and depositing shredded material into the interior volume;

a shredder opening located in the upper end of the cabinet and adapted for feeding the sheet material therethrough to the shredding means;

a shredder door adapted for pivoting between open and closed Positions, the shredder door exposing the shredder opening thereby allowing feeding of the sheet material through the shredder opening and to the shredding means when in the open position, the shredder door covering substantially all of the upper end of the cabinet, defining a substantially horizontal support surface, and closing the shredder opening thereby preventing feeding of the sheet material through the shredder opening and to the shredding means in the closed position;

a switch operatively connected to the shredder door for rendering the shredder means inoperable when the shredder opening is closed by the shredder door;

a receptacle sized for receiving and storing the shredded material from the shredding means, the receptacle being located below the shredding means and within the interior volume of the cabinet, the receptacle being accessible by opening the front door of the cabinet so as to permit removal of the shredded materials therein;

a plurality of exterior storage compartments mounted to an exterior surface of the front door; and a closable drawer accessible at the front face of the cabinet and located within the cabinet beneath the receptacle and beneath the front door.

16. A compact combination shredder and storage unit comprising:

a cabinet having a lower end, an upper end, oppositely-disposed front and rear faces between and interconnecting the upper and lower ends, and oppositely disposed side faces between and interconnecting the upper and lower ends and between and interconnecting the front and rear faces, the cabinet having a maximum dimension of less than twenty inches;

a front door defining greater than half of the front face of the cabinet, the front door being configured for opening and closing to enable and obstruct, respectively, access to an interior volume of the cabinet defined and enclosed by the front, rear, and side faces of the cabinet;

means located beneath the upper end of the cabinet for shredding sheet material and depositing shredded material into the interior volume;

a shredder opening located in the upper end of the cabinet and adapted for feeding the sheet material therethrough to the shredding means;

a shredder door adapted for sliding between open and closed positions, the shredder door exposing the shredder opening thereby allowing feeding of the sheet material through the shredder opening and to the shredding means when in the open position, the shredder door covering substantially all of the upper end of the cabinet, defining a substantially horizontal support surface, and closing the shredder opening thereby preventing feeding of the sheet material through the shredder opening and to the shredding means in the closed position;

a switch operatively connected to the shredder door for rendering the shredder means inoperable when the shredder opening is closed by the shredder door;

a receptacle sized for receiving and storing the shredded material from the shredding means, the receptacle being located below the shredding means and within the interior volume of the cabinet, the receptacle being accessible by opening the front door of the cabinet so as to permit removal of the shredded materials therein;

an exterior storage compartment mounted to an exterior surface of the front door; and a closable drawer accessible at the front face of the cabinet and located within the cabinet beneath the receptacle and beneath the front door.

17. The compact combination shredder and storage unit according to claim 16, wherein the lower end of the cabinet is adapted to rest on a support surface so that the front, rear, and side faces of the cabinet are substantially perpendicular to the support surface.

18. The compact combination shredder and storage unit according to claim 16, further comprising means located at the rear face of the cabinet for mounting the cabinet on a wall.

* * * * *